United States Patent [19]

Mentzer

[11] 4,334,983

[45] Jun. 15, 1982

[54] STRIPPING STEAM RECYCLE FOR SOLVENT RECOVERY PROCESSES

[75] Inventor: David Mentzer, Lake Hiawatha, N.J.

[73] Assignee: Exxon Research & Engineering Co., Florham Park, N.J.

[21] Appl. No.: 164,802

[22] Filed: Jun. 30, 1980

[51] Int. Cl.[3] ..... C10G 21/20

[52] U.S. Cl. ..... 208/326; 208/311; 208/322; 208/325; 423/658.5

[58] Field of Search ..... 208/326, 322, 321, 325, 208/311; 423/658.5

[56] References Cited

U.S. PATENT DOCUMENTS

| | | | |
|---|---|---|---|
| 3,451,925 | 6/1969 | Morris et al. | 208/321 |
| 3,476,681 | 11/1969 | Davies et al. | 208/321 |
| 3,590,092 | 6/1971 | Uitti et al. | 208/321 |
| 3,714,033 | 1/1973 | Somekh et al. | 208/321 |
| 3,721,620 | 3/1973 | Paret et al. | 208/317 |
| 3,763,037 | 10/1973 | Thompson | 208/326 |
| 3,864,244 | 2/1975 | Van Tassell | 208/321 |
| 4,057,491 | 11/1977 | Bushnell et al. | 208/321 |

OTHER PUBLICATIONS

Olsen, *Unit Processes and Principles of Chemical Engineering,* D. Van Nostrand Company, Inc. (1932), pp. 1–3.

*Primary Examiner*—O. R. Vertiz
*Assistant Examiner*—Wayne A. Langel
*Attorney, Agent, or Firm*—Joseph J. Allocca

[57] ABSTRACT

It has been discovered that extraction processes which employ solvents to separate components from a feed stream and which solvents are themselves recovered by stripping from the thus produced extract or raffinate or both are improved in that the solvent is stripped from the extract, raffinate or both by the use of steam which has been previously distilled from a major portion of the process stream in one of the initial stages of the solvent recovery process, which steam rather than being vented or condensed for disposal is employed as a replacement for specifically generated fresh steam. This recycle steam is employed to strip any residual solvent from the extract, the raffinate or both. The steam and any residual solvent thus stripped is recycled from the extract stripper, raffinate stripper or both to the input feed of the solvent recovery train.

This invention has application to any solvent extraction process employing solvent recovery wherein the solvent used in the process does not form an azeotrope with water.

10 Claims, 2 Drawing Figures

STRIPPING STEAM RECYCLE FOR SOLVENT RECOVERY PROCESSES

BRIEF DESCRIPTION OF THE INVENTION

It has been discovered that extraction processes which employ solvents or solvent mixtures with one solvent component being water, to separate components from a feed stream and which solvents are themselves recovered by stripping from the thus produced extract or raffinate or both are improved in that the solvent is stripped from the extract, raffinate or both by the use of steam which has been previously distilled from a major portion of the process stream in one of the initial stages of the solvent recovery process, which steam rather than being vented or condensed for disposal is upgraded to such an extent so that it can be used as a replacement for specifically generated fresh steam. This recycle steam is employed to strip any residual solvent from the extract, the raffinate or both. The steam and any residual solvent thus stripped is recycled from the extract stripper, raffinate stripper or both to the input feed of the solvent recovery train.

This invention has application to any solvent extraction process employing solvent recovery wherein the solvent used in the process does not form an azeotrope with water, and in which the major solvent is a mixture of water and some other solvent (such as NMP).

DESCRIPTION OF THE INVENTION

Figure 1:
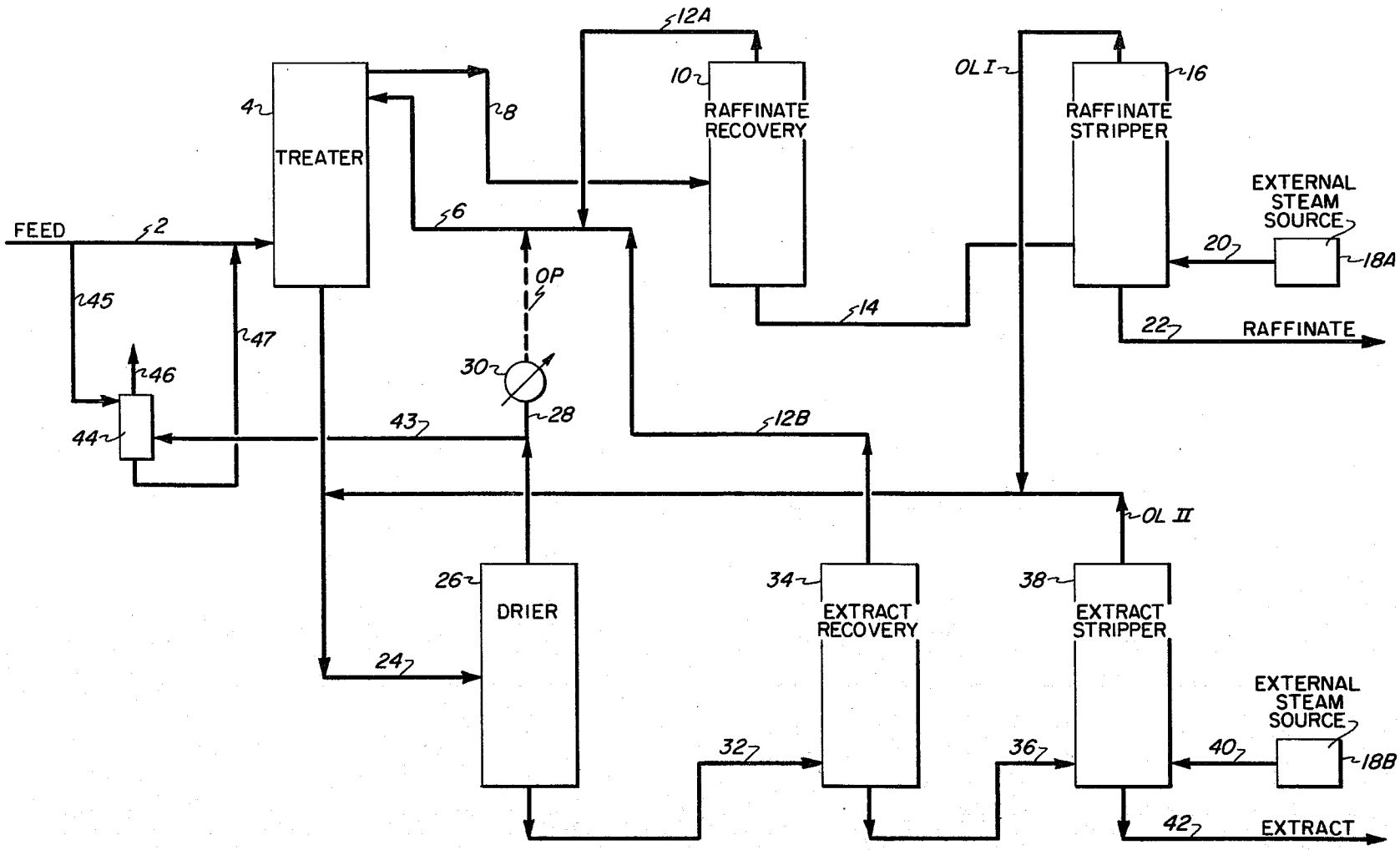
FIG. 1 is a schematic of a typical solvent extraction/-solvent recovery system.

In a solvent extraction process wherein a feed stream to be separated into a raffinate stream and an extract stream is contacted with a solvent consisting of water and some other component(s) such as NMP and wherein the solvent mixture entrained in the thus produced raffinate and extract streams is separated from the raffinate and extract components by any separation technique, yielding recovered solvent, and raffinate and extract streams containing minor amounts of solvent (i.e., 5 to 15% by volume) and wherein the raffinate and extract streams containing the minor amount of solvent are stripped of the minor amount of solvent by the use of steam, the improvement comprising the use of water vapor which has been previously distilled from a major portion of the process stream in one of the initial stages of the solvent recovery process.

In the typical solvent recovery system, this water vapor stream which is produced in drier units is normally contacted with fresh feed going into the unit so as to remove any valuable solvent traces (such as NMP) from the water vapor, which water vapor is then vented. To properly remove valuable solvent traces, the existing water vapor temperature must be below the boiling temperature of the other solvent components at the absorber tower conditions. (The tower typically operates at 230° F. for NMP). To strip solvent from the oil, the stripper tower must be hot enough (typically 500° F. for NMP). Therefore, the cold steam stream from the absorber that is typically vented would cool down the strippers and render them ineffective if used as stripping steam. The steam usually employed to strip any residual solvent from the extract and raffinate is typically specifically generated from an external source and involves complicated and expensive boiler feed water units, water purging and degassing units and the expenditure of heat energy, either by the use of additional process heat or the burning of fuel. This constitutes costs and waste which, in this efficiency minded time, should and must be eliminated.

By the practice of the instant invention, heat energy is conserved by the upgrading and use of steam which is normally wasted. Steam of high enough quality is obtained by using sufficient stages in the drier to produce pure steam and by operating the drier at sufficient pressure to produce steam of high enough pressure and temperature to be used for stripping. In place of specially generated steam for stripping residual solvent from extract and raffinate streams, a steam stream coming from a drier, which is already a part of the solvent recovery process train, is cycled to strip off the residual solvent. The thus produced residual solvent/steam stream is collected and fed to the initial feed line of the solvent recovery train wherein the solvent and water are recovered and reused both as the extraction solvent and as stripping steam.

The process of the instant invention has application to any solvent extraction process employing solvent recovery, wherein the solvent used in the process does not form an azeotrope with water. (Such as NMP/water solvent mixture used to extract low VI molecules from lubricating oil).

The Process of the instant invention will be better understood by reference to the figures.

FIG. 1 is a schematic of the typical solvent extraction/solvent recovery system. Feed in line 2 is introduced into treater 4 wherein it is contacted with a solvent stream introduced via line 6 which solvent stream may optionally contain water (line OP). In the treater, the feed is divided by the action of the solvent into an extract phase and a raffinate phase. While the treater presents a countercurrent contacting mode, any contacting technique desired may be employed. The raffinate stream containing solvent is fed via line 8 to a raffinate recovery/solvent separation zone 10 wherein the raffinate and solvent are separated one from the other by any technique common to the art. Recovered solvent via line 12(*a*) is directed to line 6, the solvent introduction line for treater 4. Recovered raffinate, still containing a minor portion of solvent is sent via line 14 to the raffinate stripper 16 wherein the residual solvent is stripped off using steam from external steam generation source 18A introduced into stripper 16 via line 20. Solvent free raffinate is recovered via line 22 while recovered solvent and steam are carried off via overhead line OLI for recycle (to be detailed below). While the raffinate stream from the treater is being processed as described above, the extract stream is also being processed. The extract stream from treater 4 is fed via line 24 to drier unit 26 wherein water with traces of solvent is separated from the extract/water/solvent stream. Part of the water/solvent overhead is carried off via line 43 for net water (stripping steam) removal from the system to avoid water build up. The mixture is sent to absorber 44 where a portion of the feed to the process is contacted with it via line 45. The feed which has absorbed the trace valuable solvent from the water is returned to the main feed line 2 via line 47. The water, free of solvent is vented at about 230° F. and atmospheric pressure. Some of the water/solvent is condensed at condenser 30 and recycled as process water via line OP. The dry extract/solvent stream from drier 26 is fed via line 32 to extract recovery unit 34 wherein the extract and solvent are separated using conventional means, the recovered solvent being carried off via overhead line 12B for eventual introduction into line 6 for recycle and the recovered extract, with a minor portion of solvent leaving unit 34 via line 36 for introduction into extract stripper 38 wherein residual solvent is stripped from the extract using steam from external steam generator 18B (which may be the same or different unit as 18A) introduced into stripper 38 via line 40. Solvent free extract is recovered via line 42 while recovered solvent and stripping steam are carried off via overhead line OLII where it is joined by the solvent/steam from the raffinate stripper in line OLI for introduction into line 24, for eventual separation into water and solvent. In order to maintain manageable water volumes and insure correct water content in the solvent, the steam or water level must be continuously monitored with any excess being vented via line 46 vent.

Figure 2:
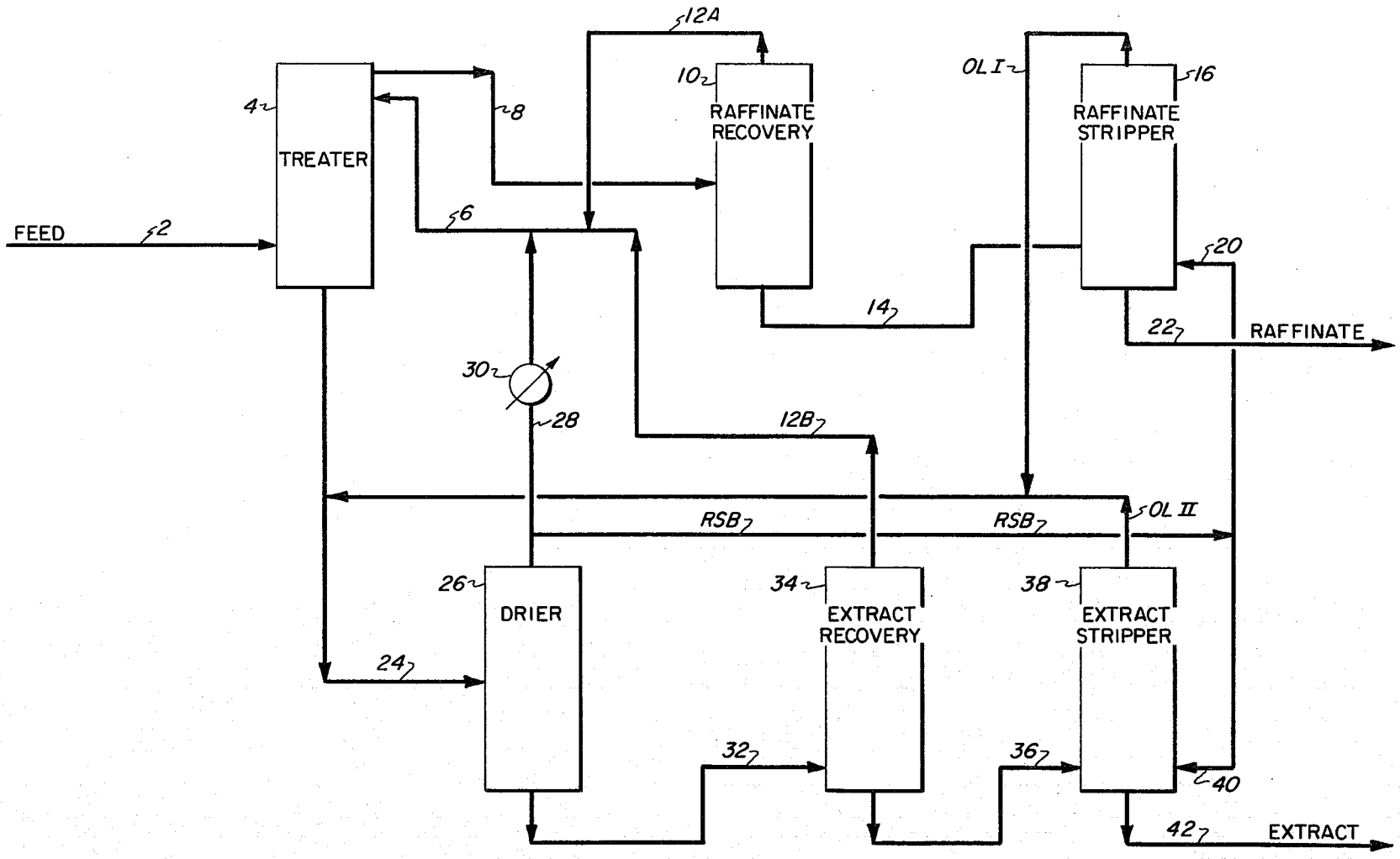
FIG. 2 is a schematic of the improved solvent extraction/solvent recovery system of the present invention employing recycle steam as stripper steam.

By way of comparison, the instant invention presented in FIG. 2 does not employ external steam generators but instead generates steam internally at a fraction of the external generation energy requirement. The steam is generated by operating drier 26 at a high enough pressure (25 psi above the stripper tower is sufficient, but higher pressures are preferred to attain a higher steam temperature) to produce steam overhead with sufficient pressure and temperature to be used as stripping steam and to produce steam overhead of sufficient purity (less than 100 ppm residual solvent) so as not to contaminate the oil products with solvent components. The recycle steam is bled from line 28 via line RSB which steam is introduced into raffinate stripper 16 via line 20 and into extract stripper 38 via line 40. Less energy is required since the essentially pure steam is already at a sufficient temperature for solvent stripping upon its exit from the drier. External steam sources are not needed. No need exists to vent excess steam since no extraneous water is introduced into the system so proper water levels are easily maintained.

Although only one drier is shown between the treater and the extract recovery unit, it must be understood that depending on the solvent system employed other driers can be similarly situated between the treater and the raffinate recovery unit with steam from either or both such drier units being employed as recycle steam in the raffinate and extract strippers. In NMP extraction no water is present in the raffinate solution. Since the above figures represent a system employing an NMP solvent, no drier was shown between the treater and raffinate recovery unit.

EXAMPLE 1

In the following example, the energy requirements of a typical NMP solvent stripping operation with solvent recovery are compared to those of the instant invention. This comparison is based on theoretical calculations and is presented so as to show the net heat and energy savings anticipated by employing the instant invention. The base case data comes from actual unit operation information.

TABLE 1

ENERGY REQUIREMENTS FOR BASE CASE AND INSTANT INVENTION

| | Instant Invention | Base Case |
|---|---|---|
| Drier Tower (26 of FIGS. 1 and 2) | | |
| Feed, lb/hr | | |
| Water | 57,830 | 895,000 |
| NMP | 10,270 | 164,000 |
| Oil | 1,820 | 34,000 |
| Temp, °F. | 330 | 366 |
| Q, $10^6$ Btu/hr | 22.8 | 395 |
| Vapor sidestream Q, $10^6$ Btu/hr | 1.9 | 107 |
| Bottoms T, °F. | 465 | 463 |
| Q, $10^6$ Btu/hr | 26.0 | 342. |
| Reboiler Q, $10^6$ Btu/hr | 7.2 | 148 |
| Net Q for overhead, $10^6$ Btu/hr | 2.1 | 65 |
| Reflux ratio, $\frac{\text{reflux}}{\text{net overhead}}$ | 0.38 | 0.36 |
| Theoretical trays above feed | 9 | 3 |
| Overhead purity, % $H_2O$ | 99.998 | 87.0 |
| Net Q per lb. of $H_2O$ recovered, Btu/#$H_2O$ | 2,010 | 2,300(1) |
| Heat required for stripping steam, $10^6$ Btu/hr | 0(2) | 21.3(3) |
| Net heat requirements, $\frac{\text{Btu}}{\text{lb of strip stm}}$ | 2,010 | 3,800 |

Notes:

(1)The Base Case heat per lb of $H_2O$ recovered may be off a bit since this calculation was not of key concern for the Base Case Study. It could be calculated as (1 + reflux ratio) times the enthalpy change in the overhead fraction in going from feed to overhead. Since reflux ratios are about the same for both cases, the heat duty should be the same. The 2300 Btu/#$H_2O$ does take into account that the overhead purity in the Base Case is less.

(2)In the Instant Invention, no additional heat is required to generate steam for stripping since stripping steam is comprised of the drier tower overheads.

(3)In the Base Case, steam for the product stripper must be generated offsite. The energy value for this steam was assumed to be 4000 lb/FOEB and 6,000,000 Btu/FOEB.

What is claimed is:

1. In a solvent extraction process wherein a feed stream is separated by contact with a solvent and water, into a raffinate stream and an extract stream and wherein both of said streams are dried in a drier to drive off the water in the form of steam and to yield water free streams and further wherein each of said water free streams is further processed to separate a major portion of the solvent from said water free raffinate stream and said water free extract stream and wherein the resulting streams containing minor residual amounts of solvent are vapor stripped in strippers to remove the residual solvent using steam as the stripping agent, the improvement comprising using as stripping steam steam generated in the raffinate and extract driers which driers are operated under conditions sufficient to produce a steam stream of high enough quality for use as stripping steam said conditions being the use of sufficient stages and sufficient pressure to produce an upgraded pure steam stream of high enough pressure and temperature to be used for said stripping.

2. The process of claim 1 wherein the steam used to strip residual solvent from the raffinate and extract streams in the raffinate and extract strippers is generated in the drier used to separate water from the extract stream.

3. The process of claim 1 wherein the steam used to strip residual solvent from the raffinate and extract streams in the raffinate and extract strippers is generated in the drier used to separate water from the raffinate stream.

4. The process of claim 1, 2 or 3 wherein the solvent extraction process is the N-methyl 2-pyrrolidone extraction of hydrocarbon oils.

5. The extraction process of claims 1, 2 or 3 wherein the solvent used in the solvent extraction process does not form an azeotrope with water.

6. In a solvent extraction process wheren a feed stream is separated by contact with a solvent and water, into a raffinate stream and an extract stream and wherein either of said streams is dried in a drier to drive off the water in the form of steam and to yield an extract or raffinate stream which is water free and further wherein the extract or raffinate water free stream is further processed to separate a major portion of the solvent from either the water free raffinate or extract stream and wherein the resulting stream containing minor residual amounts of solvent is vapor stripped in a stripper to remove the residual solvent using steam as the stripping agent, the improvement comprising using as stripping steam steam generated in the raffinate or extract drier which drier is operated under conditions sufficient to produce a steam stream of high enough quality for use as stripping steam said conditions being the use of sufficient stages and sufficient pressure to produce an upgraded pure steam stream of high enough pressure and temperatures to be used for said stripping.

7. The process of claim 6 wherein the steam used to strip residual solvent from the raffinate or extract stream in the raffinate or extract stripper is generated in the drier used to separate water from the extract stream.

8. The process of claim 6 wherein the steam used to strip residual solvent from the raffinate or extract stream in the raffinate or extract stripper is generated in the drier used to separate water from the raffinate stream.

9. The process of claim 6, 7 or 8 wherein the solvent extraction process is the N-methyl 2-pyrrolidone extraction of hydrocarbon oils.

10. The extraction process of claims 6, 7 or 8 wherein the solvent used in the solvent extraction process does not form an ajeotrope with water.

* * * * *